United States Patent [19]

McGregor et al.

[11] Patent Number: 4,920,664

[45] Date of Patent: May 1, 1990

[54] LONGITUDINAL SUPPORT SLING

[75] Inventors: Rob R. McGregor, Concord, Mass.; Kenneth W. Misevich, Griswold, Conn.; Thomas E. Mintel, Rahway, N.J.

[73] Assignee: Colgate-Palmolive Company, Piscataway, N.J.

[21] Appl. No.: 264,618

[22] Filed: Oct. 31, 1988

[51] Int. Cl.[5] ..... A43B 3/12

[52] U.S. Cl. ..... 36/11.5; 36/58.5; 128/611

[58] Field of Search ..... 36/11.5, 58.5, 7.5; 12/142.5; 128/611, 581

[56] References Cited

U.S. PATENT DOCUMENTS

| | | | |
|---|---|---|---|
| 2,190,982 | 2/1940 | Gilbert et al. | 36/11.5 |
| 2,390,685 | 12/1945 | Benson | 36/11.5 |
| 3,001,302 | 9/1961 | Farley | 36/11.5 |

FOREIGN PATENT DOCUMENTS

| | | | |
|---|---|---|---|
| 545258 | 10/1959 | Belgium | 36/11.5 |
| 0176041 | 4/1986 | European Pat. Off. | 36/11.5 |
| 1947245 | 3/1971 | Fed. Rep. of Germany | 36/11.5 |
| 575736 | 4/1924 | France | 36/11.5 |
| 6618053 | 6/1968 | Netherlands | 36/11.5 |
| 132292 | 11/1929 | Switzerland | 36/11.5 |
| 734833 | 8/1955 | United Kingdom | 36/11.5 |

*Primary Examiner*—James Kee Chi

*Attorney, Agent, or Firm*—Richard J. Ancel; Murray M. Grill; Robert C. Sullivan

[57] ABSTRACT

A foot support structure which is attached to a shoe so as to provide support to the medial arch of a foot in a longitudinal direction while acting as a supplement to the longitudinal fascia, ligaments and tendons of the foot is disclosed. The structure includes a sling strap which is most effective when employed with and anchored to a relatively flexible outsole. On the medial side of the foot, the sling pulls from a point just forward of the first metatarsal head. On the lateral side, the sling pulls from a point adjacent the posterior portion of the fifth metatarsal. The sling could also be anchored to transverse shoe components in the midfoot region. In one embodiment, the longitudinal support sling of the present invention includes a medial-lateral connector strap which extends across the top of the foot in the forefoot region and interconnects the medial and lateral sling portions proximate to the anterior portions thereof.

21 Claims, 2 Drawing Sheets

FIG. 1
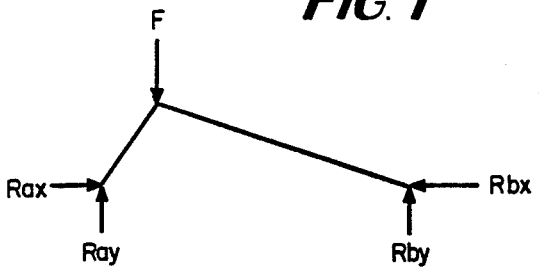
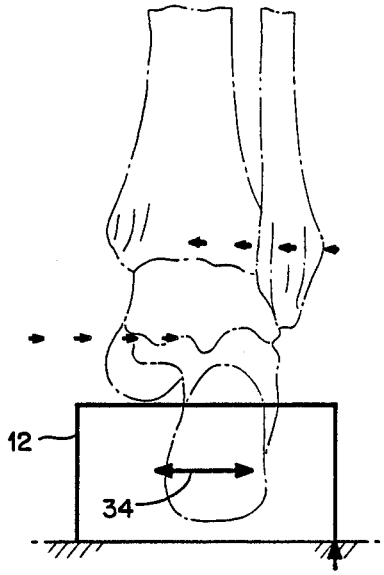
FIG. 4
FIG. 2
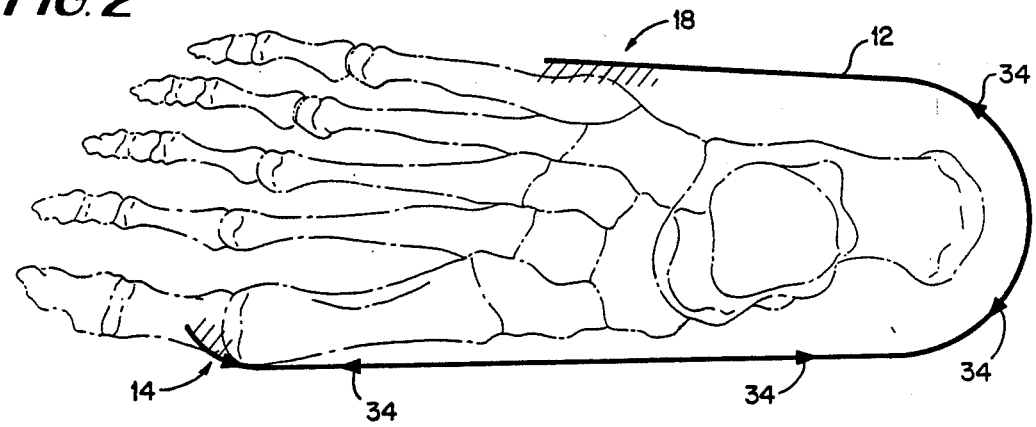
FIG. 3
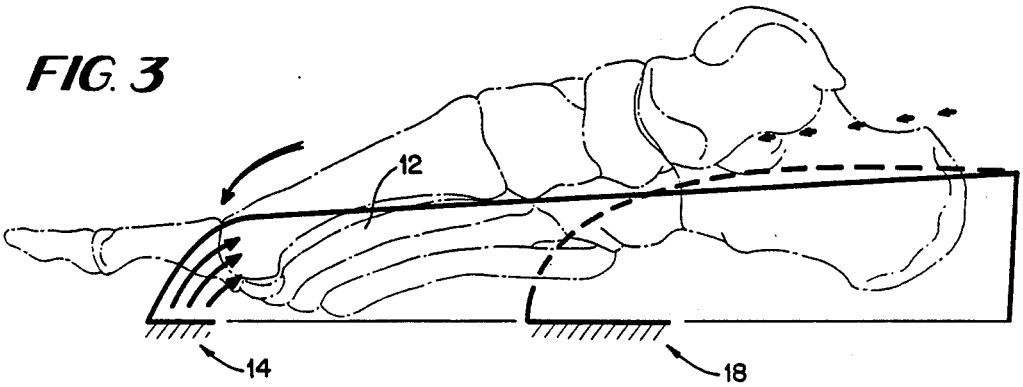

LONGITUDINAL SUPPORT SLING

BACKGROUND AND SUMMARY OF THE INVENTION

The present invention relates to a longitudinally extending sling which provides support and comfort for the medial arch of the foot. More particularly, the present invention relates to a sling which is anchored in the outsole of a shoe so as to control the girthing forces on the foot by maintaining the effective length of the longitudinal portion of the shoe. The present invention achieves some of the same benefits which have been previously obtained by taping of the foot as in the "Low Dye Strap" described hereinafter. However, the longitudinal constraint is obtained by anchoring in the shoe rather than by the use of tape on the foot itself.

In an attempt to understand the foot as a system, the various parameters which affect the function of the foot have been studied, particularly with regard to a weight bearing foot. The practical need for such knowledge lies in the fact that a true structural model of the foot is capable of providing a prediction of gait and the effects of a shoe on gait. By knowing, in advance, how a shoe would affect the performance of an athlete, for example, optimum shoes could be designed without the usual "cut and try" method of standard shoe development.

The traditional model of the foot provides for a one column, two-axis model which maintains that the foot under load is a rigid structure with a talocrural (ankle) axis and an apparent subtalar axis. The front of the foot is relatively rigid, but with only a multitude of small bone movements about the midtarses axes. The average direction of the effective axis under the ankle, called the subtalar axis, is said to be 42 degrees vertical and 16 degrees horizontal to the midline of the body, as measured by Inman, V. T., *The Joints of the Ankle,* The Williams & Wilkins Co., Baltimore, 1976. However, this theory does not hold up with regard to a weight bearing or loaded foot since, if the force due to body weight were to act on the single traditional subtalar axis, the foot would collapse mechanically.

It has now been determined that the foot is comprised of two columns and three axes. The lower, lateral column is basically a rigid base comprised of the Calcaneus, Cuboid, and the fourth and fifth metatarsals. The remainder of the foot, which is comprised of the navicular, the first, second and third cuneiforms and the first, second and third metatarsals, emanates from the talus at the talonavicular interface swinging in combination with the lower column inversion/eversion actions in what may be called the 'subtalar joint axis'. But this articulation of what is called the upper foot column is only secondary to the true foot mechanism. The primary mechanical loading interface is on the lower, lateral column at the rear of the talus onto the calcaneus, the posterior talocalcaneal facet.

It has also been determined that the foot operates differently under load than when it is passively manipulated such as a doctor would do in the office. This distinction helps to explain previous misconceptions as to how the foot works under load.

This new understanding has yielded a new structural model of the foot which has two separate columns, wrapped together with fascia, and three nearly orthogonal axes. The three axes are: (1) the talocrural (ankle) axis; (2) the talocalcaneal axis (formed at the facet between the talus and the calcaneus); and (3) the talonavicular axis (formed at the facet between the talus and the navicular bones).

The longitudinal support sling of the present invention represents a novel structure which is based on providing a supplement to the longitudinal fascia, ligaments and tendons of the foot. This supplement could be either static or dynamic. The longitudinal sling of the present invention is, in some respects, related to the well-known "Low Dye Strap" taping procedure used by podiatrists to support and comfort the medial arch of the foot.

The concept of the longitudinal support sling of the present invention as it relates to the shoe is based on the fact that, due to the physical structure of the foot, as the heel is loaded, it expands and the foot lengthens. By constraining the length between the heel and the ball of the foot, the arch is supported. The present longitudinal sling is most effective when employed with and anchored to a relatively flexible outsole. On the medial side of the foot, the sling pulls from a point just forward of the first metatarsal head. On the lateral side, the sling pulls from a point adjacent the posterior portion of the fifth metatarsal. The sling could also be anchored to transverse shoe components in the midfoot region.

As the person wearing the sling loads the foot such as while walking, the straps apply a horizontal force which aids the arch. Upon stepping down, a definite tightening of the straps can be felt. In order for the full pressure to be felt, both the rearfoot and forefoot need to be in contact with the ground. Total forefoot freedom is available with the present sling and there is a very comfortable heel girth.

In one embodiment, the longitudinal support sling of the present invention includes a medial-lateral connector strap which extends across the top of the foot in the forefoot region and interconnects the medial and lateral sling portions proximate to the anterior portions thereof. The support sling may be anchored to the outsole in the region under the toes. A heel strap may be secured to the rear heel portion of the outsole, with the heel strap having a loop for receiving the posterior portion of the support sling.

In an embodiment in which the longitudinal support sling is sewn into the outsole of a shoe, the medial-lateral connector strap would not be necessary since the sling would be anchored to the outsole. In such an embodiment, the support sling would be adhered or sewn to the outsole and thus it would not be necessary for the sling to pass all the way across the outsole in the region under the toes. In addition, there would be no need for a heel strap or loop in such an embodiment.

In order to obtain a sufficiently tight girth, the support sling girth may be adjusted before the connector strap is put in place. Then, with no load on the foot, the connector strap is secured around the medial and lateral sling portions.

The advantages of the longitudinal support sling of the present invention over the prior art devices include the fact that a perceptible feeling of support and comfort is obtained, similar in some respects to that obtained with previous taping methods, but with the advantage that the present support sling forms an integral part of the shoe. In addition, the tensioning effect of the present sling is enhanced by allowing the strap to slide around the heel instead of being adhered to it. The present invention also creates a dynamic heel cupping mechanism unlike previous shoe constructions.

Accordingly, it is a primary object of the present invention to obtain a shoe construction which provides longitudinal support to the longitudinal fascia, ligaments and tendons of the foot.

It is a further object of the invention to provide advantageous heel cushion constraint.

It is an additional object of the present invention to interactively enhance gait dynamics by linking the rear and forefoot areas.

An additional object of the present invention is to enhance the customization of heel fit in a shoe construction.

BRIEF DESCRIPTION OF THE DRAWINGS

FIG. 1 is a diagram which shows reaction forces as a foot is loaded.

FIG. 2 is a top plan view showing the bone structure of a right foot with a diagram of the lines of force acting within the longitudinal support sling of the present invention superimposed thereon.

FIG. 3 is a medial side view of the bone structure of a right foot, showing a diagram of the lines of force acting within the longitudinal support sling construction of the present invention superimposed thereon.

FIG. 4 is a posterior view of the bone structure of a right foot, showing a diagram of the lines of force acting within the longitudinal support sling of the present invention superimposed thereon.

DESCRIPTION OF THE PREFERRED EMBODIMENTS

In a conventional shoe, the arch is supported by the longitudinal fascia, ligaments and tendons. The reaction forces on and by these structural components in the so-called "x" direction, parallel to the base of the foot, are those which are supported by the present invention. By the geometry of the diagram as shown in FIG. 1, it can be seen that for a given force F, the reactions $R_{ax}$ and $R_{bx}$ can become quite large because of the mechanical advantage of the configuration. Thus it is important for the sling straps of the present invention to be relatively inextensible if they are to be functional.

Also it is critical that the anchor points secure the foot firmly to the outsole. If the foot is allowed to slide relative to the outsole, then the effectiveness of the sling will be substantially reduced.

Figure 5:
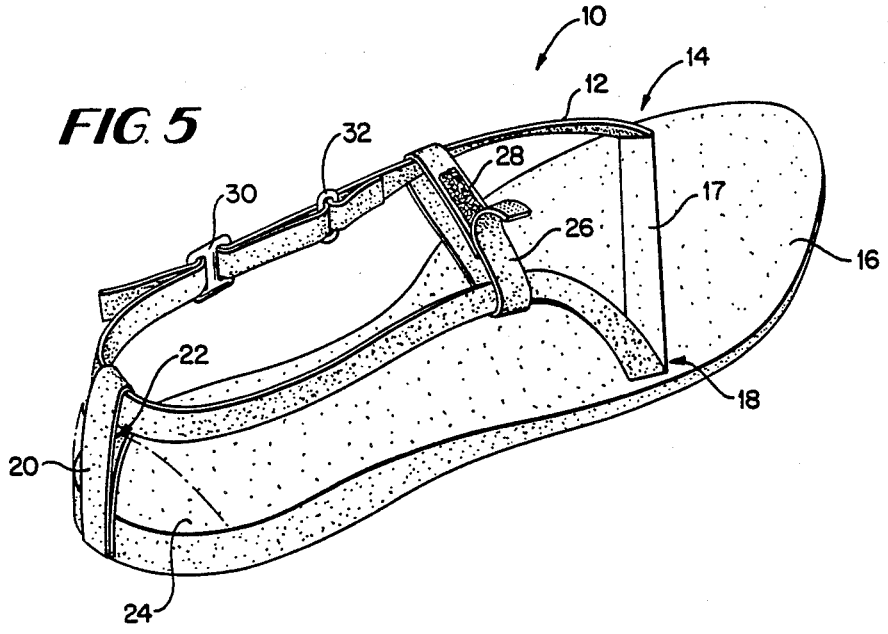
FIG. 5 is a perspective view showing one embodiment of the longitudinal support sling of the present invention installed on an outsole.
Figure 6:
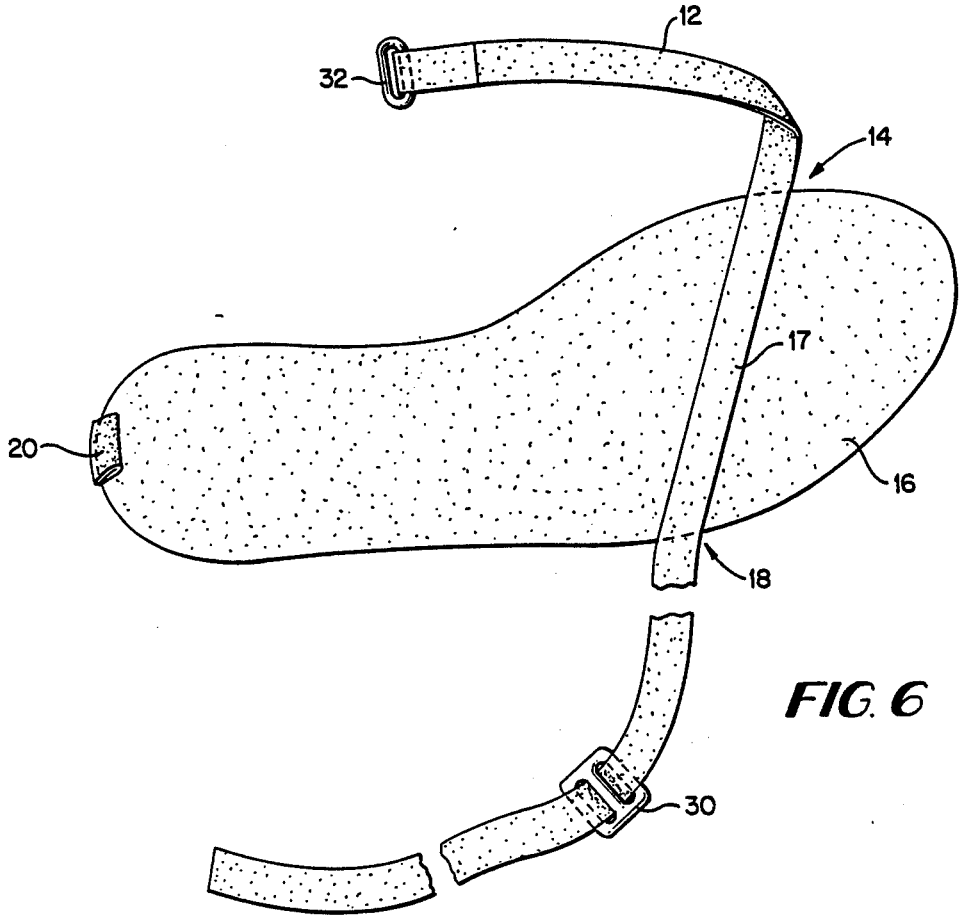
FIG. 6 is a top plan view of the longitudinal support sling of FIG. 5 showing the strap in the unsecured condition.

In the embodiment of the present invention as shown in FIGS. 2 through 6, there is provided a longitudinal support sling 10 of the present invention which supports a human foot in a longitudinal direction by varying the effective length of the longitudinal portion of the shoe. The sling 10 includes a strap 12 which is anchored at a position 14 anterior to the first metatarsal on the medial side of the outsole 16 to provide a "chock" configuration. On the lateral side of the outsole 16, the sling strap 12 is anchored to the outsole 16 at a position 18 proximate and adjacent the posterior portion of the fifth metatarsal. The anchoring of the strap 12 under the toes proceeds from position 14 to position 18 as shown in FIGS. 5 and 6, and the strap may be secured to the upper surface of the outsole 16 in this region 17 by means such as a suitable adhesive bonding composition.

A heel strap 20 is secured to the rear heel portion of the outsole 16, and the heel strap 20 is provided with a loop 22 in the upper portion for receiving the sling strap 12 so as to prevent the sling strap 12 from "riding up" the heel. A heel cup 24 may also be mounted in the heel portion of the outsole 16 if desired, as shown in FIG. 5.

A medial-lateral connector strap 26 extends across the top of the foot in the forefoot region and interconnects the medial and lateral portions of the longitudinal sling strap 12 at positions proximate to the anterior ends of these medial and lateral sling portions. The purpose of the connector strap 26 is to assist in maintaining the medial and lateral portions of the sling strap 12 in a position parallel to the outsole 16 so that the tensioning forces act in a horizontal direction as much as possible when the foot is in a loaded condition. A suitable adjustable fastening means 28 is employed to allow the tensioning effect of the sling strap 12 to be varied. In one embodiment, the fastening means was in the form of hook and pile retention means, generally identified in the trade as a Velcro attachment.

The ends of the sling strap 12 are releasably secured by the use of a suitable buckle 30 and loop 32 device. In this manner, a free slip region is provided in the area of the heel at the extreme posterior region of the outsole 16.

As a foot is loaded, the heel fat pad expands and the foot begins to elongate as the arch depresses. The longitudinal support sling strap 12 of the present invention acts to constrain the heel in conjunction with the outsole heel cup 24 but also draws on the flexible outsole 16 to lift the outsole slightly to prevent the forefoot from slipping forward.

In FIGS. 2 through 4, there are shown diagrammatic views of the sling strap 12 of the invention, with the anchor points 14, 18 being shown on the respective medial and lateral sides of the foot. The arrows 34 in the heel area indicate the feature of the invention whereby the strap 12 goes into tension as the foot is loaded.

In carrying out the taping method of the prior art, the line of force of the taping method starts on the lateral border of the side of the foot just posterior to the fifth metatarsal, then proceeds around the back of the heel and along the medial border ending at a position anterior to the first metatarsal head. As the heel strikes and bulges, the tape constrains the foot by not allowing it to expand.

The longitudinal strap 12 of the present invention follows essentially the same path as the tape. Whereas the taping method requires adhesion to pull back on the first metatarsal, adhesion to the skin cannot be employed in a shoe. Since there is no way to anchor a strap to the side of the metatarsal, the rearward force must be achieved by the creation of a "wedge" in front of or anterior to the first metatarsal head which is pulled back by the longitudinal support sling, thus constraining the forefoot from expanding as the foot is loaded and preventing the arch from collapsing.

In order for the sling of the present invention to be effective, the outsole 16 of the shoe must be relatively flexible so that the outsole can be raised up under the toes. The term "relatively flexible" as used to describe the outsole 16 is intended to mean that the outsole 16 is flexible enough so that it forms a first metatarsal chock to prevent the foot from slipping forward which would render the invention substantially inoperable. As an example, a polyurethane outsole having a thickness of about ½ inch and a Shore A hardness of about 30 to 50 durometer may be employed. Since the lateral border of the strap 12 is anchored to the upper and therefore to the outsole 16, there must be a length adjustment to accommodate the many variations in foot size and shape. However, the strap 12 must be relatively inextensible in order to provide the needed support.

The term "relatively inextensible" should be defined for the purposes of the present invention. Conventional shoe laces are typically woven structures in which fiber alignment provides that large strains must be produced before a significant load can be handled. One typical shoe lace strained 5% but carried a load of only five pounds. While a shoe lace has a continually increasing modulus, it is more beneficial, with regard to the present invention, for the support sling fibers to have a significant initial modulus which remains linear throughout the effective support range. Such a property allows significant forces to be supported at much lower strains. This is the inextensibility required for the support sling straps of the present invention.

Various methods of anchoring, adjusting and fastening or closing the sling may be employed. Also, the details of the resulting lines of force around the first metatarsal head, as well as the action in the outsole of the shoe which results from the shoe construction of the present invention, are important features of the present invention.

The hoop which includes the sling strap 12 as well as the outsole 16 between the medial and lateral anchor points should not strain or elongate more than about 10 percent under body loads of the order of two to three body weights. Generally, the greatest strap loadings will occur during action such as intense running and such loadings would be transmitted longitudinally throughout the strap.

In one embodiment of the invention, the sling strap 12 of the invention was in the form of a $\frac{5}{8}$ inch polyester strap having a length of approximately 24 inches. The modulus of the strap 12 may be about 525 pounds per inch per inch, for example. A polyurethane adhesive was employed to secure the strap to the outsole 16 in the region 17. A metal loop 32 was employed in conjunction with a buckle 30 known as a Fastex fastener. In the heel region, adhesive means or other suitable means was employed to secure the heel strap 20 to the posterior end of the outsole 12 and the heel strap 20 in this embodiment was a 1 inch polyester strap having a length of approximately 5 inches before being doubled back upon itself to form the loop 22. The medial-lateral connector strap 26 in this embodiment was a 1 inch polyester strap.

The sling strap 12 as shown in FIGS. 5 and 6 may be of any suitable width and a relatively wide strap 12 may be employed. However, if the strap 12 is too wide, it may tend to lift off the foot at certain points, thus creating excessive local pressures on the foot. A wide inextensible strap will have directionality problems and will cause local pressure points. A wide strap also takes away from the ability to adjust the strap properly. It is also within the scope of the present invention to employ a plurality of relatively narrow width straps rather than a single strap of greater width.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A foot support structure which is attached to a shoe so as to provide support to the medial arch of a foot in a longitudinal direction while acting as a supplement to the longitudinal fascia, ligaments and tendons of the foot, comprising:

a shoe outsole having medial and lateral side portions and a heel portion; and a sling strap having a pair of anterior end portions, one anterior end portion being secured adjacent said medial side portion of the outsole and the other anterior end portion being secured adjacent said lateral side portion of the outsole, said sling strap extending around the periphery of said heel portion and having a portion extending along the medial and lateral side portions of said outsole, the anterior end portion of said sling strap on the medial side portion being anchored to said outsole at a position anterior to the location of the first metatarsal of the foot and with the anterior end portion of said sling strap on the lateral side portion being anchored to said outsole at a position proximate and adjacent a location of the posterior portion of the fifth metatarsal of the foot.

2. The foot support structure of claim 1, further including:

means for slidably securing said sling strap to the heel portion of said outsole; and a medial-lateral connector strap extending across a top portion of the foot in a forefoot region and interconnecting portions of said sling strap at positions adjacent to each of said anterior end portions.

3. The foot support structure of claim 1 wherein a heel cup is mounted in the heel portion of said shoe outsole.

4. The foot support structure of claim 2 further including means for adjusting the length of said connector strap.

5. The foot support structure of claim 1 further including means for adjusting the length of said sling strap.

6. The foot support structure of claim 1 wherein said anterior end portions of the sling strap are joined by a strap member which is secured to the upper surface of said outsole and which extends from the medial side portion to the lateral side portion of said outsole.

7. The foot support structure of claim 2 wherein said connector strap is slidably adjustable along a portion of said sling strap located on the medial and lateral side portions of said outsole.

8. The foot support structure of claim 2 wherein said means for slidably securing said sling strap to the heel portion includes a heel strap attached to the heel portion of said outsole and extending upwardly therefrom, said heel strap having an opening in the upper end thereof through which said sling strap passes.

9. The foot support structure of claim 1 wherein a hoop which includes the sling strap and the outsole between medial and lateral anchor points of said sling strap does not strain or elongate more than about 10 percent under body loads of the order of two to three body weights.

10. The foot support structure of claim 1 wherein said sling strap is of a relatively inextensible material.

11. The foot support structure of claim 1 wherein said outsole is of a relatively flexible material.

12. The foot support structure of claim 1 wherein said sling strap is anchored to the outsole in a region under the toes.

13. The foot support structure of claim 1 wherein a plurality of sling straps are employed.

14. The foot support structure of claim 1 wherein said sling strap is allowed to slide around the heel portion rather than being fixed to the heel portion.

15. The foot support structure of claim 1 wherein the foot is secured firmly to said outsole.

16. The foot support structure of claim 5 wherein said means for adjusting the length of said sling strap includes a buckle and loop device.

17. The foot support structure of claim 1 wherein said outsole is formed of polyurethane having a thickness of about ½ inch and a Shore A hardness of about 30 to 50 durometer.

18. The foot support structure of claim 1 wherein said sling strap is in the form of a ⅝ inch polyester strap having a length of approximately 24 inches.

19. The foot support structure of claim 18 wherein the sling strap has a modulus of about 525 pounds per inch per inch.

20. The foot support structure of claim 8 wherein said heel strap and said connector strap are each in the form of a 1 inch polyester strap.

21. The foot support structure of claim 9 wherein said sling strap is of a relatively inextensible material and said outsole is of a relatively flexible material.

* * * * *